United States Patent [19]

Fuma et al.

[11] Patent Number: 4,908,291

[45] Date of Patent: Mar. 13, 1990

[54] METHOD OF REGULATING THE THICKNESS OF A DEVELOPER LAYER CONTAINING MAGNETIC CARRIER AND TONER PARTICLES

[75] Inventors: Hiroshi Fuma; Akihiko Tamura; Masahiko Itaya; Hisashi Shoji; Shinobu Soma, all of Hachioji, Japan

[73] Assignee: Konishiroku Photo Industry Co., Ltd., Tokyo, Japan

[21] Appl. No.: 273,107

[22] Filed: Nov. 16, 1988

Related U.S. Application Data

[63] Continuation of Ser. No. 15,376, Feb. 17, 1987, abandoned.

[30] Foreign Application Priority Data

Feb. 18, 1986 [JP] Japan ..... 61-34318
Feb. 18, 1986 [JP] Japan ..... 61-34319

[51] Int. Cl.[4] ..... G03G 13/09
[52] U.S. Cl. ..... 430/122; 118/657; 430/45
[58] Field of Search ..... 430/120, 121, 122; 118/657

[56] References Cited

U.S. PATENT DOCUMENTS 4,386,577 6/1983 Hosono et al. ..... 118/657
4,458,627 7/1984 Hosono et al. ..... 118/657

FOREIGN PATENT DOCUMENTS 2070982 9/1981 United Kingdom ..... 118/653

OTHER PUBLICATIONS

Hosoya et al., Xerographic Development Using Monocomponent Non-Magnetic Toner, Electrophotography vol. 26, No. 2 (1987) pp. 107–114.

*Primary Examiner*—J. David Welsh
*Attorney, Agent, or Firm*—Jordan B. Bierman

[57] ABSTRACT

The present invention provides a method of regulating the thickness of developer layer formed on a developer-transporting means by transporting the layer to a layer thickness-regulating means disposed so as to face with the developer transporting means, pressing the layer by the layer thickness-regulating means so that the layer thickness-regulating distance of the pressing portion between the layer thickness-regulating means and the developer-transporting means can be made substantially equal to the diameter of single developer particle, and allowing the layer to pass through the pressing portion while keeping the layer thickness-regulating distance substantially equal to the diameter of single developer particle.

43 Claims, 8 Drawing Sheets

FIG. 23-a
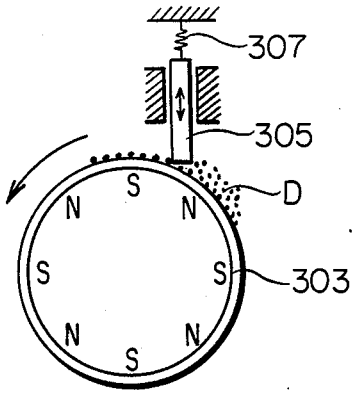
FIG. 23-b
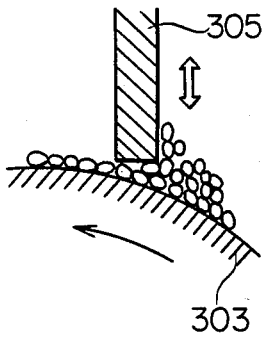
FIG. 24-a
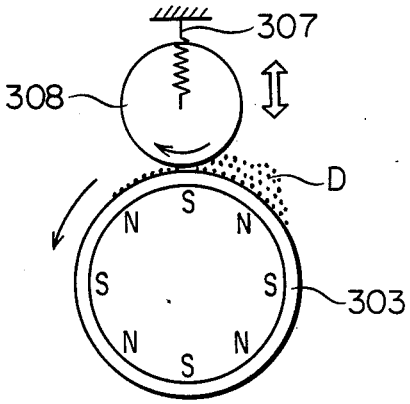
FIG. 24-b
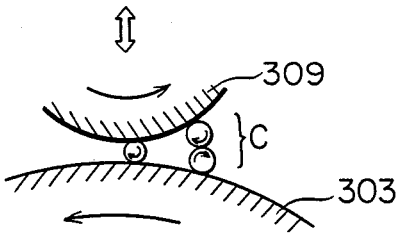

METHOD OF REGULATING THE THICKNESS OF A DEVELOPER LAYER CONTAINING MAGNETIC CARRIER AND TONER PARTICLES

This application is a continuation, of application Ser. No. 015,376, filed Feb. 17, 1987, now abandoned.

BACKGROUND OF THE INVENTION

The present invention relates to a developing means to develop a latent image on an image forming member, especially, the similar member employed in electrophotography, and more specifically relates to an improved method of forming a developer layer whereby the thickness of developer being carried and transported on a developer transporting member is regulated.

In the electrophotography in which an electrostatic latent image on an image forming member is visualized through development to obtain final image, the current developing methods are roughly categorized into two developing methods, one of which is a method of using one-component developer and the other is a method of using two-component developer comprising magnetic carrier and non-magnetic toner.

Among the developing methods to use one-component developer, a developing method using one-component non-magnetic developer has difficulty in forming a stable and uniform developer layer, because the force to carry the developer on a developer transporting member solely comprises Coulomb force and van der Waals force derived from electrical charge the developer has. Additionally, with a developing method using one-component magnetic developer, it is difficult to obtain vividly colored toners other than black one, because the toner generally contains black colored magnetite powder as magnetic material. On the other hand, the developing method to use two-component developer has, when compared with other methods, an advantage capable of forming a stable developer layer and using vivid color toners.

Generally speaking, when developing a latent image on an image forming member with a developer carried and transported on a developer transporting member, the smaller distance between a latent image carrying member and a developer transporting member can sharpen contrast of an image obtained, realizing the improved image quality. In a contact-developing method wherein the development is carried out by making the image carrying member in contact with the developer layer, when the distance between the image carrying member and the developer layer is set smaller, it is necessary to limit the amount of developer being carried and transported on the developer transporting member within a proper range in order to prevent developer from being pressed to form a solid between the image carrying member and the developer transporting member or to protect the latent image or the developed image against damage caused by such a pressure. Incidentally, the term "amount of developer" refers to the weight per unit area of developer being carried on the surface of developer transporting member. Additionally, even in a non-contact-developing method wherein the development is carried out by keeping the image carrying member detached from the developer layer, if the distance between the image carrying member and the developer layer is set smaller, it is necessary to limit the amount of developer on the developer transporting member within a proper range so that the image carrying member may not contact the developer layer.

In conventional developing methods using two-component developer, the development have been carried out with, for example, a developing unit having the following constitution. A cylinder-shaped nonmagnetic member or nonmagnetic belt is used as a developer transporting member, and magnets are disposed on the opposite side of the developer carrying surface of the developer transporting member. Such magnets may be, by an arrangement whether they are disposed fixedly or rotatably in relation to a certain axis, arranged to satisfy the conditions of development. 0f developer being carried on the developer carrying surface, the magnetic carrier receives force from the field of magnets disposed opposite to the developer carrying surface and rises to form the fur in accordance with the force of magnets as well as the magnetism of carrier, thus, the carrier is retained on the developer carrying surface. Being agitated in a developer container, magnetic toner is rubbed with magnetic carrier and is given triboelectricity. Accordingly, nonmagnetic toner and magnetic carrier are attracted with each other due to Coulomb force as each of them is provided with an electrical charge of which polarity is opposite to each other. As magnetic carrier is retained on the developer carrying surface due to the field of magnets, nonmagnetic toner together with magnetic carrier is retained on the developer carrying surface, and, accordingly, the developer layer comprising magnetic carrier and nonmagnetic toner is formed on the developer carrying surface. The developer layer is retained and transported on the developer carrying surface to develop the latent image on the image carrying member.

Such a developer layer should, as mentioned above, satisfy the minimum requirements that the layer is not so pressed as to form a solid through the gap between the image carrying member and the developer transporting member, and that the image carrying member and the developer layer both of which should be kept separate with each other are kept in no contact.

Furthermore, the developer layer should satisfy the following requirements:

(1) "Fogging" phenomenon where toner deposits on the surface of image carrying member other than the image area does not occur.

(2) "Carrier adhesion" phenomenon where carrier deposits on the surface of image carrying member does not occur.

(3) Proper amount of toner to be able to provide an image having enough density deposits on the latent image area.

(4) The deposited toner image has gradient sufficient to reproduce the gradient of a latent image.

To satisfy these requirements, the properties of developer, the agitating method of developer, the properties of latent image carrying member, the relative velocity between the latent image carrying member and developer layer, the means for forming a latent image on the latent image carrying member, electrical bias applied across the image carrying member and the developer transporting member, the force of magnets, the configuration of magnetic field, and the like should be kept within adequate ranges. Such requirements further include the amount of developer on developer carrying member and the thickness of developer, whose adequate ranges are much smaller than those for the minimum requirements.

A conventional layer thickness regulating means was so constituted that, in order to provide the required amount and thickness of developer layer retained on the outer circumference surface of a developer carrying member, a developer layer thickness regulating plate 205 made of metal or resin and shown in FIG. 20 was disposed in a close proximity to the surface of developer transporting member 203, and that developer D is carried while being retained on the surface of developer transporting member 203 and is transported to the developing area after passing trough the gap between the layer thickness regulating plate 205 and the surface of developer transporting member 203. . The developer transporting member 203 shown in the figure is one example wherein the member comprises a nonmagnetic cylinder internally housing magnets 204.

To regulate the layer thickness of developer D at approx. 1 mm or less by using such a layer thickness regulating plate 205, the gap distance between the layer thickness regulating plate 205 and the surface of developer transporting member 203 should be set at approx. 0.5 mm or less. Because, developer D passes through the gap between the developer layer thickness regulating plate 205 and the developer transporting member 203 in the form of compacted higher density developer layer, but, contrary, developer D on the surface of the developer transporting member 203 after passing through the gap between the layer thickness regulating plate 205 and the developer transporting member 203 rises due to the force of magnets 204 to form a lower density developer layer with thickness 1.5–3 times as large as that of the layer passing through the gap between the thickness regulating plate 205 and the developer transporting member 203.

Ordinary photocopying machines, printers and the like which develop and visualize an electrostatic latent image have a several hundred mm of image width. To set the gap, mentioned previously, between the layer thickness regulating plate and the surface of developer transporting member at approx. 0.5 mm or less and to maintain it evenly and stably across all the span of image width necessitates high-precision manufacture and adjustment of the layer thickness regulating plate, which cannot be easily carried out.

Therefore, it is the object of the present invention to provide a method for forming developer layer, wherein a high-quality image is obtainable by using developer which may use vivid color toner and comprises magnetic carrier and nonmagnetic toner being capable of forming a stable developer layer, and by evenly and stably forming a thin developer layer which can allow to set a latent image carrying member unconventionally closer to a developer transporting member.

SUMMARY OF THE INVENTION

According to the present invention, the above-mentioned object is attained by positioning the front edge of resilient plate member supported by a supporting member to the upstream side of developer moving along a developer transporting member and by pressing the resilient plate member upon the developer transporting member so as to regulate the layer thickness of developer containing magnetic carrier and toner which are deposited and transported on the developer transporting member.

Furthermore, with the present invention, developer layer is formed and maintained by setting the gap distance between a developer layer thickness regulating means and a developer transporting member substantially equal to the particle diameter of magnetic carrier contained in developer having the above-mentioned magnetic carrier and toner and by allowing the above-mentioned developer to pass through the above-mentioned gap.

Each of FIGS. 10, 11, 12 and 13 shows one example of resilient plate member having a different configuration.

Figure 11:
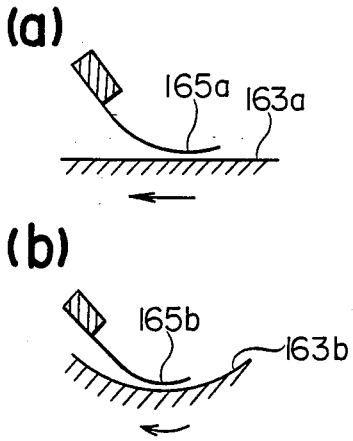
Figure 12:
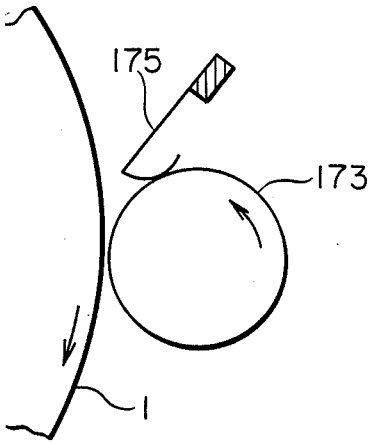

Each of FIGS. 11 and 12 shows a positional relation between a resilient plate member having a different configuration and an agitating member.

Figure 16:
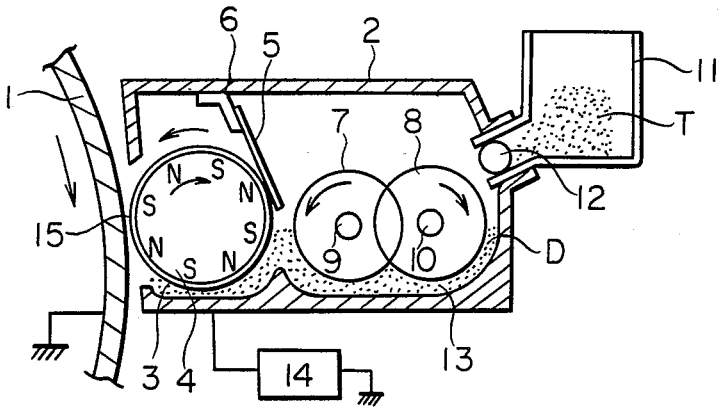

FIG. 16 is a sectional view illustrating a developing unit according to the invention.

Figure 17A:
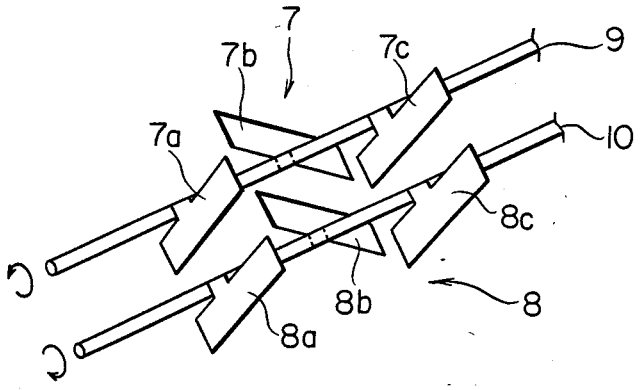
Figure 17B:
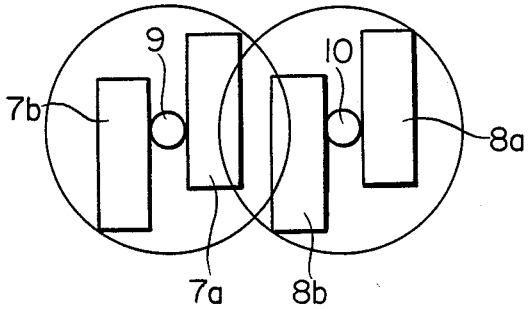

FIG. 17*a* is a perspective side view illustrating an agitating member. FIG. 17*b* is a front view of the agitating member.

FIG. 18*a* is a sectional view illustrating the principal area of one example of a photocopying machine according to the invention. FIG. 18*b* is a sectional view illustrating a laser optical system.

Figure 19:
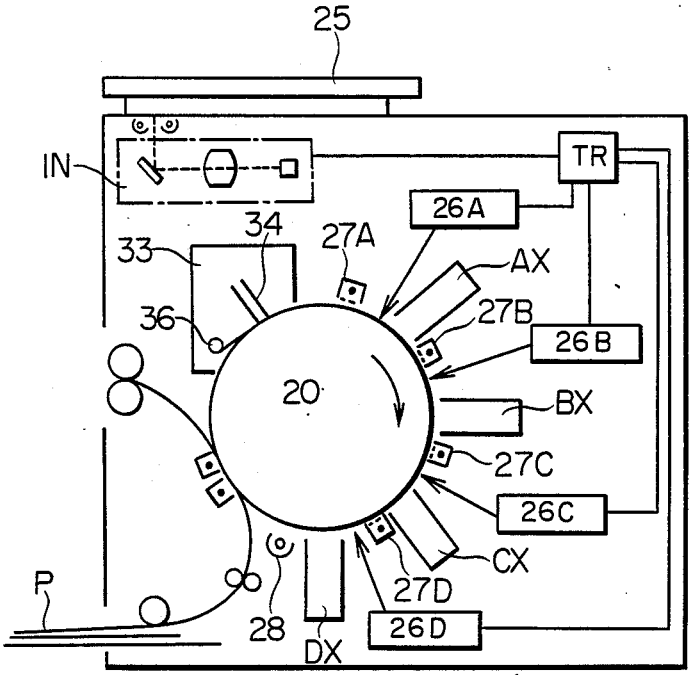

FIG. 19 is a sectional view illustrating the principal area of one example of an image forming apparatus according to the invention.

Figure 20:
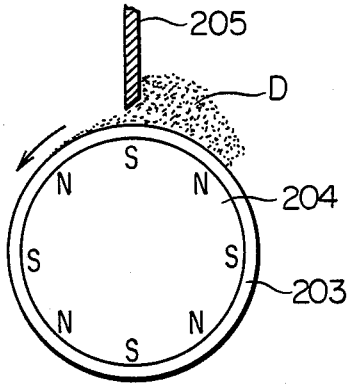

FIG. 20 is a sectional view illustrating a conventional pressing force regulating means for developer layer.

Figure 21:
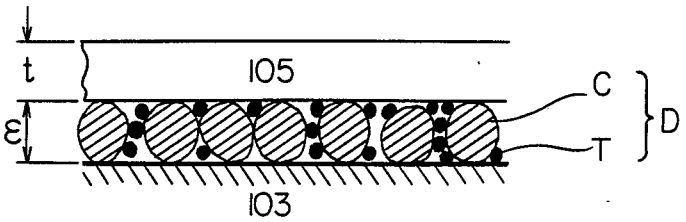
Figure 22:
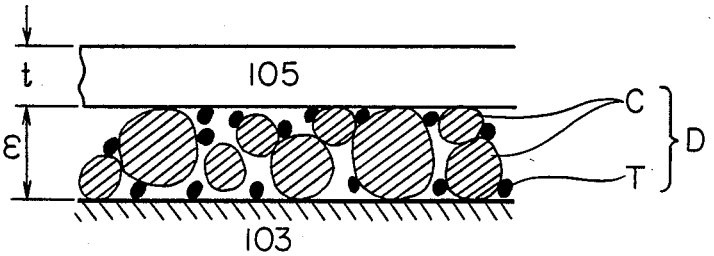

Each of FIGS. 21 and 22 is an enlarged detail showing the state formed between a developer transporting member and a resilient plate member.

FIG. 23*a*, 23*b*, 24*a* and 24*b* are side views showing other examples of the layer thickness-regulating means.

DETAILED DESCRIPTION OF THE INVENTION

Figure 1:
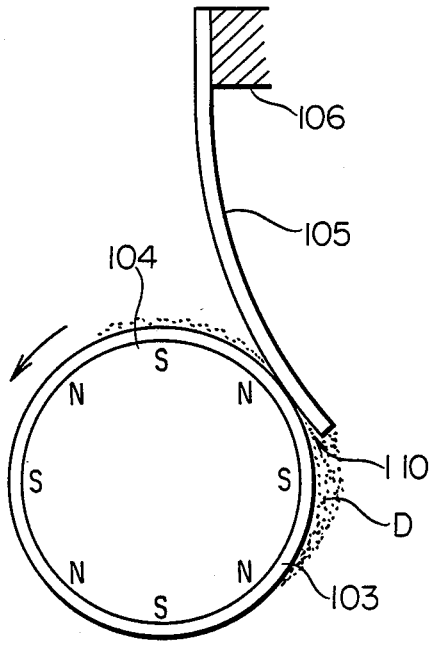
FIG. 1 is a side view of an example according to the invention.

FIG. 1 illustrates one example of a developer layer thickness regulating means according to the invention.

A resilient plate member is pressed upon the surface of a developer transporting member in such a manner that the tip of the resilient plate member faces the upstream side of the developer transporting member. Accordingly, as shown in the figure, a nonmagnetic cylinder is employed for the developer transporting member 103, and the resilient plate member 105 having a flat-shape is pressed upon the surface of the developer transporting member 103, then a wedge-shaped gap 110 is formed between the tip of the resilient plate member 105 and the point of contact where it is pressed upon. When the developer transporting member 103 is rotated toward a specific direction, developer D carried on the developer transporting member 103 with magnetic field of magnets is separated into two portions: one of which enters the wedge-shaped gap 110; other one of which fails to enter the wedge-shaped gap 110 and is sent to one side of the resilient plate member 105 opposite to the developer transporting member 103. Among these portions, only the portion of developer D which enters the wedge-shaped gap 110 is passed through between the developer transporting member 103 and the resilient plate member 105 by the frictional force exerted by the developer transporting member 105 and then is transported to the developing area. In this case, the amount of developer passing through between the developer transporting member 103 and the resilient plate member 105 is determined by the entrance height of the wedge-shaped gap 110 as well as the pressing force with which the resilient plate member 105 is pressed upon the developer transporting member 103. Naturally, this is applicable only when the conditions including the previously mentioned properties of developer, agitating method, field and force of magnets and others are kept constant.

In other words, if the entrance of the wedge-shaped gap 110 is smaller, the amount of developer entering the wedge-shaped gap 110 is smaller, and the amount of developer passing through between the developer transporting member 103 and the resilient plate member 105 is also smaller. Additionally, if greater force is applied to press the resilient plate member 105 upon the developer transporting member 103, the amount of developer passing through becomes smaller, because greater counter force is needed to lift the resilient plate member 105 while developer passes through between the developer transporting member 103 and the resilient plate member 105.

Figure 2:
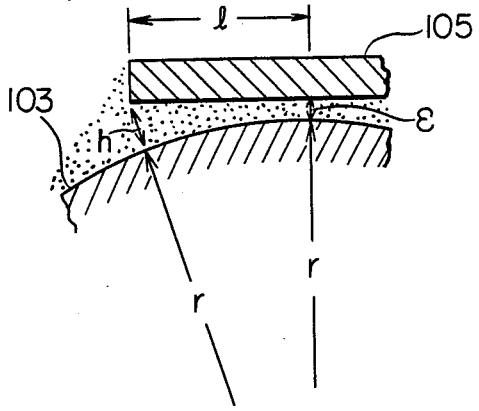
FIG. 2 is an enlarged fragmentary view of FIG. 1.

The entrance height of the wedge-shaped gap is determined by the following expression pertinent to the fragmentary view in FIG. 2.

$$h = \sqrt{l^2 + r^2} - r + \epsilon$$

The proportion of the variation of height h to the variation of tip margin of the resilient plate member is approximately 10:1, if the curvature radius r of the developer transporting member 103 is 10 mm and the height h of the entrance is 0.1 mm. If the curvature radius r is greater, the proportion becomes by far greater. In the large proportion of the variation of tip margin 1 of the resilient plate member 105 to the variation of height h of the entrance portion that the minute adjustment in correspondence with the proportion is available when the height h of the entrance is set by adjusting the tip margin 1 of the resilient plate member 105. Additionally, with a conventional developer layer thickness regulating plate, its deflection or the like greatly varies the gap between the developer layer thickness regulating plate and a developer transporting member. Contrary, with this method of the invention, wherein the resilient plate member is pressed and bent against the developer transporting member, the deflection of the resilient plate member is absorbed into such a bend, and the influence on the formation of uniformly thick developer layer is negligible.

Next, the pressing force with which the resilient plate member 105 is pressed upon the developer transporting member 103 is described.

Developer D coming into the wedge-shaped gap 110 through its entrance is further forced to proceed into the narrower section of the gap 110 by the frictional force working between magnetic carrier and the developer transporting member 103 caused because magnetic carrier is attracted onto the developer transporting member due to the magnetic field exerted from the magnets disposed on the internal circumference surface of developer transporting member 103, and by the pressure caused by pushing developer D continuously into the wedge-shaped gap 110. Being forced to proceed into the gap 110, developer D lifts the resilient plate member 105 and passes through between the resilient plate member 105 and the developer transporting member 103. If the gap distance between the resilient plate member 105 and the developer transporting member 103 in the area where developer passes through is larger than a single carrier particle, what supports the resilient plate member 105 comprises not only the element of force which is vertical to the resilient plate member 105 and is derived from the force to push developer D forward but the force with which carrier rises along the magnetic field generated by the magnets. Also, when the gap distance between the resilient plate member 105 and the developer transporting member 103 approximately equals the diameter of single carrier particle, the strength of carrier supports the resilient plate member 105. Accordingly, to further reduce the gap distance between the resilient plate member 105 and the developer transporting member 103, it is necessary either to physically prevent developer D from entering into the gap between the resilient plate member 105 and the developer transporting member 103 or to apply the pressing force great enough to break carrier particles. The gap distance, between the resilient plate member 105 and the developer transporting member 103, and the pressing force constitute the correlation shown in FIG. 4. In other words, the gap distance between the resilient plate member 105 and the developer transporting member 103 remains constant when it is equal to the diameter of carrier particle throughout the wide range of pressing force with which the resilient plate member 105 presses the developer transporting member 103, thereby allowing easy adjustment of the resilient plate member 105.

In the following manner, it is ascertained that the gap distance between the resilient plate member 105 and the developer transporting member 103 is equal to the diameter of one piece carrier particle. Firstly, on the condition that the resilient plate member 105 is pressed on the developer transporting member 103 and the developer is not yet presence onto the developer transporting member 103, a dial gauge (minimum scale: 0.01–0.001 mm) available in a market is secured after its probe is so set as to come in contact with the not-pressed face of the resilient plate member 105 at pressing point of the resilient plate member onto the developer transporting member 103. At this stage, the developer transporting member is moved toward the specified direction (opposite to the direction of the tip margin of resilient plate member), causing carrier to enter into the wedge-shaped gap to lift up the resilient plate member. Then, such lifting motion in turn lifts up the probe of dial gauge. The distance of lifting motion corresponds with the gap distance between the resilient plate member and the developer transporting member.

Supposing that the average particle diameter of carrier particles which have been classified prior to employment is $\bar{d}$, a currently practiced ordinary carrier production process results in a distribution in the carrier particle diameter, wherein carrier particles being 0.5 through 2.0 times as great as the average particle diameter exist in comparatively large proportion, but, in addition, the similar particles being smaller than 0.5 times the average diameter or larger than 2.0 times the diameter also exist though limited in number. As shown in FIG. 21 as well as FIG. 22, when a developer layer comprises carrier particles substantially forming a single layer, that the developer layer thickness is approximately equal to the particle diameter of carrier means that the distance e between the resilient plate member and the developer transporting member measured with the above-mentioned measuring method is, when considering the dispersion of the particle diameter of carrier, expressed by the following inequality expression.

$$0.9 \times d \leqq \epsilon \leqq 2.0 \times d$$

FIG. 21 shows an example where the dispersion of carrier particle diameter is smaller. FIG. 22 shows another example where the dispersion of carrier particle diameter is greater.

Figure 4:
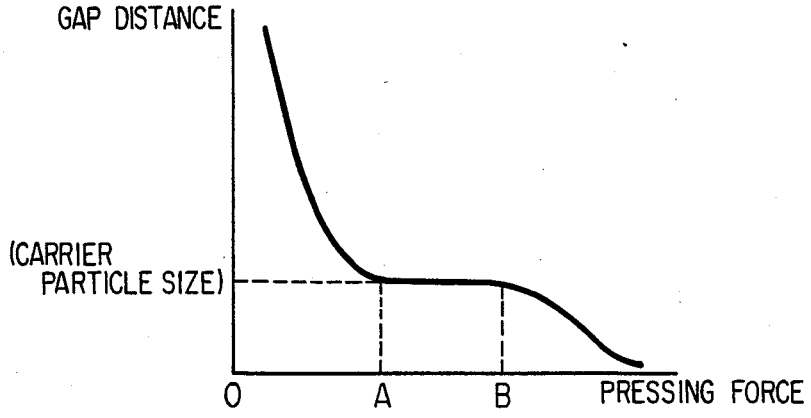
FIG. 4 is a graphical presentation illustrating the correlation between the gap distance and the pressing force, in one example according to the invention.

The present invention is intended to enlarge the allowable setting range for the pressing force with which the resilient plate member is pressed upon the developer transporting member, as well as to make developer layer consist of a single layer of carrier, by adjusting the pressing force with which the resilient plate member is pressed upon the developer transporting member within the range A through B in FIG. 4.

Even if the gap distance between the resilient plate member and the developer transporting member is kept constant, the amount of developer rushing into the entrance of wedge-shaped gap varies and the pressure with which developer is forced into the gap also varies when the height of entrance of the wedge-shaped gap at the tip margin of resilient plate member varies. Because of this reason, it is also necessary to regulate the height of entrance of the wedge-shaped gap. However, as shown in FIG. 4, when the pressing force exists within the range A through B, the influence of the above mentioned height is smaller than that of the similar force smaller than A. Because, in the range where the pressing force is smaller than A, the gap distance between the resilient plate member and the developer transporting member is changed according to the change in force which lifts up the resilient plate member because of the change in height of entrance of the wedge-shaped gap, and, in contrast, the pressure the resilient plate member exerts on the developer transporting member is born by the strength of carrier between the resilient plate member and the developer transporting member, when the pressing force is within the range A through B, and the element of force vertical to the resilient plate member derived from the force with which developer is pushed into the wedge-shaped gap is smaller enough when compared with the pressing force within this range.

However, even if the gap distance between the resilient plate member and the developer transporting member is kept constant corresponding to the diameter of single carrier particle, the amount of developer passing through the gap decreases accordingly when the amount of developer to rush into the wedge-shaped gap decreases. This is the case where the height of entrance to the wedge-shaped gap is excessively small.

Figure 5:
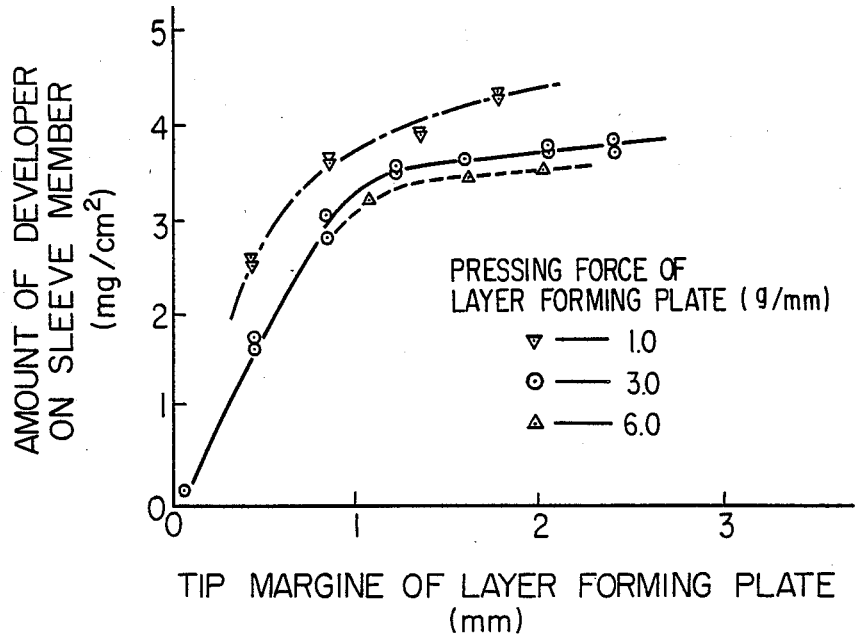
FIG. 5 is a graphical presentation illustrating the correlation between the tip margin of resilient plate member and the amount of developer, in relation to the example.

FIG. 5 shows the results of experiment, illustrating such correlation. In this graphical presentation, the tip margin 1 of the resilient plate member shown in an enlarged fragmentary view in FIG. 2 is arranged to the direction of axis of abscissae, while the amount of developer on developer transporting member is arranged to the direction of axis ordinates. Three curves were obtained by varying the pressing force exerted by pressing the resilient plate member upon the developer transporting member. The tip margin 1 on the axis of abscissae may be converted into the height h of entrance of the wedge-shaped gap by using the previously mentioned expression $$h = \sqrt{l^2 + r^2} - r + \epsilon.$$

In this experiment, 18 mm dia. nonmagnetic cylinder internally provided with a 700 Gauss strong magnetic roll having eight poles was employed as a developer transporting member. As a resilient plate member, a 0.1 mm thick phosphor bronze plate having 12 mm free length was used. The developer comprises resin coated carrier having 30 μm particle diameter and toner having 10 μm particle diameter mixed at the ratio of 4:1. The revolution of magnetic roll is 531 rpm and the roll is rotated to the direction opposite to that of the nonmagnetic cylinder being rotated at 180 rpm.

It is obvious from this graphic presentation that, as mentioned previously, if the height h of entrance of the wedge-shaped gap is small, that is, if the tip margin 1 of resilient plate member 105 is small, the amount of developer entering into the wedge-shaped gap is small, and, accordingly, the amount of developer on the developer transporting member is small after developer passing through between the resilient plate member and the developer transporting member. Additionally, when the height of entrance is larger than a certain point, the amount of developer becomes almost constant, because it becomes the primary factor determining the amount that the distance of gap where developer passing through stably equals to the particle diameter of one piece of carrier particle.

In relation to the pressing force the resilient plate member exerts upon the developer transporting member, there is a slight difference between the pressing forces 1 g/mm and 3 g/mm, and, little difference between the pressing forces 6 g/mm and 3 g/mm. Based on such results, it is obvious that in this experiment the pressing force A in FIG. 4 is around 0.5–1 g/mm. However, as for the pressing force B, it is only apparent that the force is greater than 6 g/mm. However, an excessively large pressing force exerts great pressure upon carrier and toner interplaced between the developer transporting member and the resilient plate member, causing carrier and toner particles to crush, abrade or fuse, and, thereby producing finer-particle carrier and toner which cause fogging in the course of development as well as adhesion of carrier particles on the developed image. These particles may also firmly adhere to form films on the resilient plate member and the developer transporting member. Furthermore, various disadvantages may take place. For example, the resilient plate member or the developer transporting member may wear due to the friction with carrier or toner, or, the resilient plate member may be permanently deformed. In addition, as the greater load is exerted on a member (for example, a developer container casing) which sets the positioning between the resilient plate member and the developer transporting member, resulting in larger and heavier developing units. To eliminate or limit such disadvantages within the allowable range for practical use, it is better that the pressing force with which the resilient plate member is pressed upon the developer transporting member may be kept within 1–10 g/mm, or, preferably, 1–5 g/mm.

It was revealed through the experiment that the amount of developer passing through is kept constant within the range 3–4 mg/cm$^2$, with 0.08–0.3 mm entrance height of the wedgeshaped gap, 1–3 mm tip margine of the resilient plate member and 0.5–6 g/mm pressing force the resilient plate member exerts upon the developer transporting member. The method for forming a developer layer according to the present invention is characterized by the wider allowable setting range, easier assembly and adjustment, and higher reliability.

The developer used in this case comprises, in terms of weight proportion, nine parts of carrier having 30 μm particle diameter of which ferrite cores are coated with styrene-acrylic resin as well as one part of toner having 10 μm particle diameter which is composed of 45 parts weight polystyrene, 44 parts weight methacrylate and 10.5 parts weight carbon black and is produced by mixing and kneading them.

Next, the description of the material, thickness and free length of the resilient plate member is as follows. The requirements in the invention are the pressing force which a resilient plate member exerts upon a developer transporting member, as well as the entrance height of wedge-shaped gap formed between the tip margin of the resilient plate member and the developer transporting member. The pressing force F is expressed by the following expression, using the parameters in FIG. 3.

$$F = \frac{Et^3}{6} \cdot \frac{\theta}{PQ^2} = \frac{Et^3}{6} \cdot \frac{1}{\left(\frac{m^2 + S^2 - 2Sr}{2S}\right)^2 \mathrm{Sin}^{-1}\left(\frac{2Sm}{m^2 + S^2}\right)}$$

where, E denotes the elastic modulus of resilient plate member, for example;

Phosphor bronze = 11200 kg/mm$^2$

Stainless steel = 20000 kg/mm$^2$ t denote the thickness of resilient plate member. The expression does not hold when the value of $\theta$ becomes greater, however, as the arc PQ (when one end of resilient plate member is secured and force is exerted upon one point of free area of the member, the section between the secured end and the exerted point forms an arc having radius R) is long enough, the expression can be provide much accurate approximation.

The value of pressing force F may be arbitrarily designated, by properly selecting the material and thickness (E and t) of resilient plate member, and the position ($\theta$and PQ) where the plate is pressed, in accordance with the developer transporting member (in this case, cylindrical shape) to be employed.

However, the pressing force should be, as mentioned previously, within the range 0.5–10 g/mm, and, when a certain parameter is set excessively large or small, allowable ranges for the other parameters is too strictly limited, necessitating higher accuracy for assembly, adjustment and processing. The smaller E, t and $\theta$, as well as larger arc PQ enlarge the allowable setting ranges for the other parameters, wherein the developer layer comprises a magnetic carrier and toner, the thickness-regulating distance is substantially equal to the diameter of the single carrier particle, and preferably satisfies the following equation:

$$0.9d \leqq \epsilon \leqq 2.0d$$

wherein d is the diameter of the single carrier particle and $\epsilon$ is the thickness-regulating distance. When a magnetic toner is employed, d would denote the diameter of the single magnetic toner article.

The thickness-regulating means comprises an introducing member for introducing a controlled quantity of the developer layer in the pressing portion. The introducing member is disposed so as to form an introducing gap between the introducing member and the developer transporting means. A separating means separates the transported developer into at least two groups, and introduces one group of said transported developer into the processing portion.

Additionally, these parameters are also restricted not only by the designated value F but other conditions.

Figure 3:
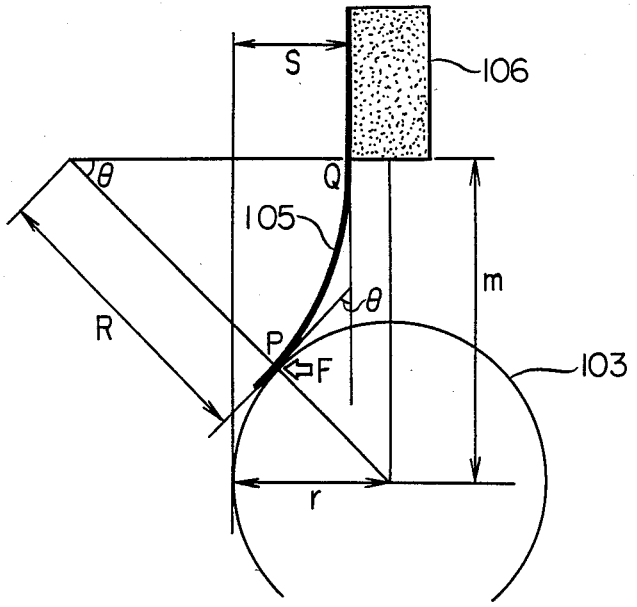
FIG. 3 is a schematic diagram of FIG. 1.

Incidentally, in FIG. 3, the distance m between the end 106 of resilient plate member where it is secured and the center (the rotational axle of cylinder, if a developer transporting member is cylinder-shaped) corresponding with the curvature of the surface of developer transporting member 103 changes the varying rate, which corresponds with the positioning variation of the resilient plate member, of the pressing force F. For example, when a material whose elastic modulus E is 10000 kgf/mm$^2$ and thickness t is 0.1 mm is used for the resilient plate member, and if the distance m is set 12 mm, 0.1 mm variation of setting position S causes the pressing force F to vary by approximately 0.4 g/mm when the force F is 3g. According to the results of experiment in FIG. 5, the error in pressing force as much as +3 g ~ −2 g is regarded as permissible, and the error in setting position corresponding to the above-mentioned error is approximately +0.7 mm ~ −0.5 mm. Therefore, the position setting which determines the pressing force is much easier compared with the position setting for a conventional resilient plate member. Additionally, in relation to the error in setting position, the error to the direction in which the resilient plate member is brought close to the developer transporting member is regarded as a positive error.

Unlike a method using a conventional developer layer thickness regulating plate member, with the developer layer forming apparatus according to the invention wherein a resilient plate member is pressed upon a developer transporting member, the variation of amount of developer as well as the developer thickness both of which affect property of development is small against the variation of setting position of developer thickness regulating plate member, enabling easy setting of the amount of developer as well as the developer thickness with high-precision.

Figure 6:
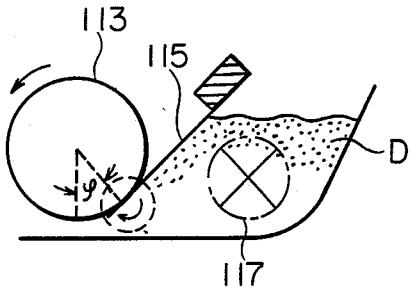
FIGS. 6, 7 and 8 illustrate three examples, with each of which a pressure point of a resilient plate member on a developer transporting member is different.
Figure 7:
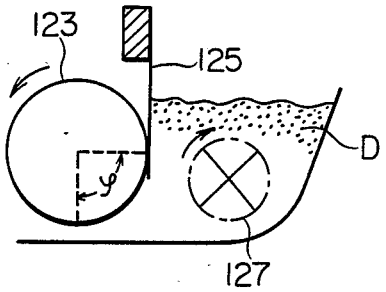
Figure 8:
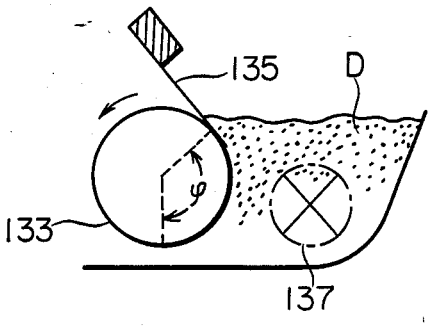

If a resilient plate member 113 is pressed, in the position shown in FIG. 6, upon a developer transporting member 113, the movement of developer in relation to the resilient plate member 115 becomes as shown by the arrow, eliminating the circulation of developer in and outside the area circled with a broken line and reducing the toner density, and deteriorating the image quality. In the case of a cylindrical developer transporting member, as shown in FIGS. 6, 7 and 8, a resilient plate member is pressed upon a developer transporting member at the point where a radius rotated by $\psi$ from the perpendicular line extending from the center of cylinder to a developer container meets the outer circumference surface of the cylinder. The angle $\psi$ should be more than 30°, and, more preferably, more than 60°. Additionally, as shown in FIG. 8, if the resilient plate member 135 is pressed upon a developer transporting member 133 at the position near the top surface of developer in a container or above the top surface of developer, it is impossible to form a uniformly thick and stable developer layer, because enough amount of developer is not supplied into between the resilient plate member 135 and the developer transporting member 133. The position where a resilient plate member is pressed upon a developer transporting member should be set deeper than 2 mm, and, preferably, deeper than 5 mm from the top surface level of developer in a developer container. Numeral 117 in FIG. 6, numeral 127 in FIG. 7 and numeral 137 in FIG. 8 respectively denote an agitating member for agitating developer contained in a developer container.

As can be understood from the description, above, there are limitations on the position where a resilient plate member is pressed upon a developer transporting member. Also, the limitations on size of a developer container in turn limit the arc PQ. o make a developer container as small as possible, its height is preferably approximately that of a developer transporting member. Accordingly, in order to enlarge the arc PQ, it is necessary to dispose a resilient plate member inclined, as shown in FIG. 6, which in turn disadvantageously influences the circulation of developer as mentioned previously. Therefore, the range of arc PQ is, when the radius of developer transporting member is r, set as $0.5r \leqq PQ\ 2r$, or, preferably, $0.7r \leqq PQ \leqq 1.5r$.

Figure 9:
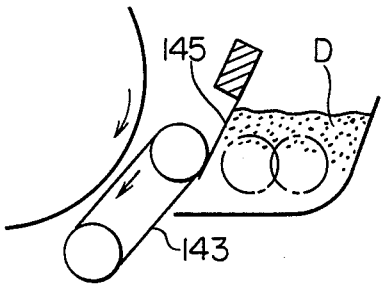
FIG. 9 shows one example using a belt-shaped developer transporting member.

Incidentally, the above-mentioned conditions may be applicable only when a developer transporting member is cylinder-shaped. If a belt-shaped developer transporting member 143 is used, as shown in FIG. 9, the conditions vary. An elastic modulus is a value inherent to a material of resilient plate member. The larger the value is, the larger force to deflect it to the same extent of the deflection is required. Accordingly, the smaller the elastic modulus E of resilient plate member is, the smaller the variation of pressing force F for the same extent of the deflection is, and the larger are the allowable ranges for other parameters to limit the pressing force F within specific ranges. Additionally, like the elastic modulus E, the smaller the thickness t of resilient plate member is, the larger the allowable ranges for other parameters are. Especially, the thickness t influences the force F proportional to the cube thereof. Therefore, the selection of t is extremely important. When a resilient plate member whose elastic modulus E is 10000 kgf/mm$^2$ is utilized, and if PQ=10 and t=0.1, the reading S in FIG. 3 is 0.6–5.6 mm against the pressing force 1–10 g/mm. If E is 20000 kgf/mm and other parameters are unchanged, S becomes 0/3–3.0 mm. If t=0.2 mm and other parameters are designated same as the first example, S becomes 0.08–0.75 mm, reducing the allowable setting ranges. A thinner resilient plate member is vulnerable to an external force, necessitating careful handling and deteriorating production yield. Because of the above-mentioned reasons, it is advantageous to use with this method the resilient plate member having elastic modulus E 5000–25000 kg/mm$^2$ an thickness t 0.03–0.2 mm, and, preferably, the elastic modulus E 7000–22000 kg/mm$^2$ and the thickness t 0.05–0.15 mm. As specific materials for a resilient plate member, phosphor bronze, copper, brass, steel, stainless steel and the like are advantageous.

With a conventional means for forming a developer layer, as shown in FIG. 20, particles larger than the gap between the members 205 and 203 fail to pass through and are jammed between the developer layer forming member 205 and the developer transporting member 203, hindering the further passage of following developer or tending to cause the abnormal movement of developer in the wedge-shaped gap. Contrary to this, with a method according to the present invention, as a resilient plate member easily deflects, as shown in FIG. 1, when a foreign matter smaller than the entrance height of wedgeshaped gap and larger than the normal gap distance (essentially, equal to one layer of carrier) between the resilient plate member and the developer transporting member rushes into the gap, the resilient plate member is lifted at the area where there is the foreign matter, allowing it to pass through. In contrast, in the case of a foreign matter larger than the entrance height of gap, as it fails to remain even around the tip of resilient plate member due to the thinness of resilient plate member, passing along the back surface of resilient plate member not facing to the developer transporting member, and returning to a developer container. The term "foreign matter" refers to a contaminant such as a metallic fragment, resin particle, paper particle or the like, and an agglomeration of developer or the like.

Additionally, for the development using a one-component developer, a method to press a resilient plate member upon a developer transporting member was proposed (for example, in Japanese Patent Examined Publication No. 35018/1984). However, according to the present invention, as developer contains carrier having larger particle diameter and high-hardness, the filming of developer which was conventionally found on a resilient plate member as well as a developer transporting member when one-component developer was used is removed due to a scraping effect of carrier, remarkably extending the service life of a resilient plate member as well as a developer transporting member.

Next, the constitution of a developing unit employing the method for forming a developer layer, in accordance with the present invention, is described, below. Where, non-magnetic cylindrical developer transporting member is utilized. However, such a member may be of beltshaped or flat type, as far as a wedge-shaped gap of specific size is formed at the area where developer rushes into, when the resilient plate member is pressed onto the developer transporting member in such a manner as in compliance with the configuration of the latter member. A rotating magnetic roll is provided inside the cylinder, and, for this purpose, fixed magnets may be used instead, in accordance with the requirements for development. Furthermore, in terms of the requirements for development, bias voltage is applied on a nonmagnetic cylinder (hereinafter referred to as a sleeve) in order to carry out non-contact reversal development. However, the method for forming a developer layer, according to the invention, may be applicable to contact development as well as normal development.

FIG. 16 gives a sectional view for a developing unit which is advantageous in applying the method for forming a developer layer, according to the invention. In the figure, numeral 1 denotes an image forming member, numeral 2 a housing, and numeral 3 a sleeve. Numeral 4 denotes a magnetic roll having four N poles and four S poles, and numeral 5 a developer layer forming member. Numeral 6 is securing the member 5. Numeral 7 denotes a first agitating member, numeral 8 a second agitating member, and numeral 9 is a rotatable shaft for the agitating member 7. Numeral 10 is a rotatable shaft for the agitating member 8. Numeral 11 is a container for toner to be supplied, numeral 12 a roller for supplying toner, and numeral 13 a developer reservoir. Numeral 14 denotes a development bias supply, and numeral 15 a developing area. T represents toner, and D shows developer. In such a developing unit, developer D within the developer reservoir 13 is thoroughly agitated with the first agitating member 7 rotating in the arrow direction as well as with the second agitating member 8 being interlocked with the first member and rotating in the direction reverse to the arrow, then, transferred and attracted upon the surface of the sleeve 3 by the carrying force of sleeve 3 rotating in the arrow direction and the magnetic roll 4 rotating reverse to the sleeve. On the surface of the above-mentioned sleeve 3 is pressed the abovementioned layer forming member 5 secured by the securing member 6 extending from the housing 2. This layer forming member 5 functions to regulate the thickness of developer D transported in the abovementioned manner.

Though without contact with a latent image, such a developer layer develops the latent image, across the gap, on the image forming material 1 rotating in the arrow direction, thus forming a toner image.

During development, the bias supply 14 applies onto the sleeve 3 a development bias comprising direct, which is approximately equivalent to the potential of non-exposure area on the image forming material 1, and alternating current components. As a result, only toner within developer on the sleeve 3 is selectively transferred on the area of the above-mentioned latent image, where it deposits.

Additionally, a layer thickness of developer may be measured in the following manner, for example. With a NIKON profile projector manufactured by Nippon Kogaku K.K., a position of a projected image of sleeve on a screen is compared with a position of a projected image which has incorporated the layer formed on the sleeve, in order to determine the thickness of the layer.

The above-mentioned developer layer forming member 5 is provided with elasticity by the securing member 6 securing one end thereof, and comprises an extremely evenly formed thin plate made of a magnetic or non-magnetic metal, metallic compound, plastic, rubber or the like, and has the thickness 10–500 μm.

As mentioned previously, the amount of developer to be carried are regulated by resiliently pressing the area near one end of a developer layer forming member, of which other end being secured in the previously mentioned manner, upon the sleeve 3, so as to pass each carrier particle one by one at the contacting point the sleeve 3 contacts the layer forming member.

Foreign matters as well as conglomerates of carrier and/or toner cannot pass through the point of regulation. Accordingly, the thin developer layer transported to the developing area 15 and having stable and uniform thickness is constantly available.

Additionally, the amount of developer to be carried to the developing area 15 is regulated, as mentioned previously, by varying the pressing force as well as the contacting point at which the abovementioned thin layer forming member 5 is pressed upon the sleeve 3.

As mentioned previously, it is regarded as more advantageous to use finer carrier and toner composing developer for better developability as well as gradient reproducibility. For example, when carrier contained in developer layer and having a particle diameter smaller than 50 μm is used, an evenly thin layer can be formed by employing a means, for example, like the above-mentioned layer forming member 5, in order to automatically reject inpurity or aggregation contained within developer. Furthermore, even if the particle diameter of the above-mentioned carrier is set nearly as small as that of toner, the involvement of inpurity is also eliminated, allowing the formination of thin layer with an even thickness.

On the contrary, in order to prevent the adhesion of carrier onto an image forming material, the larger particle diameter of carrier is advantageous, because stronger magnetic force exerts on the carrier with larger particle diameter. Even if the particle diameter of carrier is 30–100 μm, for example, a thin developer layer having uniform thickness may be formed with the previously mentioned method. Additionally, when the particle diameter of carrier is too large, the height of fur comprising carrier contained in the thin layer becomes too large, coarsening the developer layer and deteriorating developability. For this reason, it is desirable to make the particle diameter of carrier less than 100 μm when the strength of magnetization is, for example, 15–30 emu/g.

Incidentally, such magnetization of the carrier is measured by D.C. magnetization measuring apparatus (manufactured by Yokogawa Hewlet Pakard Co., Ltd) with the measuring magnetizing field 1000 Gauss.

FIG. 17*a* shows a perspective side view, and FIG. 17*b* shows a front view both of which specifically illustrates the structure of agitating members 7 and 8 to be incorporated into the abovementioned developing units. In the figures, each of numerals 7*a*, 7*b* and 7*c* denotes an agitating blade on the first agitating member, and each of numerals 8*a*, 8*b* and 8*c* denotes an agitating blade on the second agitating member. The blades may take a shape whichever square, disc, oval and the like. Each blade is secured on each of rotatable shafts 9 and 10 at its own angle and/or position. The above-mentioned two agitating members 7 and 8 are so arranged that their agitating areas overlap with each other, while their agitating blades do not collide with the blades of the other agitating member. Due to this arrangement, agitation in the left and right directions (FIG. 16) as well as in the frontward and rearward directions (FIG. 16) are thoroughly effected.

Additionally, toner T supplied from a hopper 11 via a roller 12 for supplying toner is in a short time evenly mixed into developer D.

As described above, developer D which has been thoroughly agitated and provided with desirable triboelectricity is, while it is applied and transported on the sleeve 3, regulated with the above-mentioned layer forming member 5 to form an extremely thin and uniform developer layer. Such a developer layer is transported to one direction with the rotation of sleeve 3, and, at the same time, a magnetic bias having a vibrating element is generated by the rotation of magnetic roll to the reverse direction, causing complicated movements such as rolling and the like on the above-mentioned sleeve 3, thus enabling effective feeding of toner onto the latent image area when the developer reaches to the developing area 15 and develops a latent image on the image forming material 1 without contacting the image. The above-mentioned developer layer is, as mentioned above, of extremely thin layer (10–1000 μm). Accordingly, the non-contact developing is satisfactorily enabled with the gap, or the developing gap, between the image forming material 1 and the sleeve 3 reduced to, for example, 500 μm. When the developing gap is narrowed to such an extent, the electric field in the developing area becomes greater, allowing the satisfactory development even with the smaller development bias applied onto the sleeve 3, and advantageously minimizing the leaking discharge and the like of development bias. Furthermore, the image quality including resolution and the like of the image obtainable from the development improves as a whole.

The development method using an extremely thin developer layer and described above is significantly advantageous when used in a developing unit having a small diameter sleeve. In other words, when carrying out the non-contact development with a developing unit having a small diameter sleeve with a diameter less than 30 mm, for example, it was conventionally necessary to provide a developing gap with a gap distance approximately 1 mm, because the regulation of developer layer thickness accompanied difficulties. For this reason, a high power alternating bias was required. Also such a method involved disadvantages that the resolution and gradient reproducibility of the image obtainable from development as well as the image quality as a whole degenerate, making it impossible to reproduce the details of characters, especially, and that the designing for electrical insulation of developing unit is extremely difficult.

In contrast, with the development method using the method for forming a developer layer, according to the invention, as the development is effected by forming an extremely thin developer layer, the developing gap may be narrowed, and the sufficiently great electrical field may be provided. Accordingly, the resolution and gradient reproducibility of a developed image as well as the image quality as a whole are remarkably improved. Additionally, as a small diameter sleeve may be incorporated, the otherwise expensive developing unit is miniaturized and its cost is accordingly lowered. Also, in the color electrophotography or the like which involves many developing units, it is advantageous in simplifying disposition of such units, and in realizing an apparatus compact in size.

Furthermore, as other effects obtainable from the method for forming developer layer, according to the invention, the scattering of carrier and toner is minimized even if carrier and toner comprising fine particles are employed. In other words, when developer comprising carrier and toner made of fine particles were used in accordance with a conventional method, the carrier and/or toner had scattered and soiled inside an apparatus, or scattered color toner had contaminated a developing unit containing a different color toner, and then disturbed color balance of an image or caused fogging. Contrary, the development method of the invention totally eliminates such disadvantages.

Other advantages of the present invention include that as the non-contact development is used as development method where only toner is selectively allowed to fly toward the latent image area for development, the fogging of toner or the filming of carrier on the latent image area, which tends to happen especially when the reversal development is carried out using an image forming member having an organic photosensitive layer, is eliminated. Additionally, as the latent image area is not rubbed, the surface of image forming member is free from damages, or the brush pattern is not formed. Accordingly, the excellent resolution and gradient reproducibility are realized, and the sufficient amount of toner may be applied onto the latent image area. The method according to the invention is suitable for multi-color development, because the development may be further carried out on in already-formed toner image on the image forming member.

As the stable development conditions in the development according to the invention, the developer thickness may be 10–1000 μm, or, more preferably, less than 400 μm, and the developing gap may be 200–1200 μm.

Next, the composition of toner contained in developer which is applied to the developing method according to the invention is as follows.

(1) Thermoplastic resin (binder) 80–90 wt %
  Ex: polystyrene, styrene-acrylic polymer, polyester, polyvinylbutyral, epoxy resin, polyamide resin, polyethylene, ethylene-vinyl acetate copolymer and the like, or mixture involving the above-mentioned materials.

(2) Pigment (colorant) 0–15 wt %
  Ex: Black: carbon black
  Yellow: benzidine derivative
  Magenta: Rhodamine B Lake, carmine 6B and the like
  Cyan: copper phthalocyanine, sulfonamide derivative dye and the like (3). Charge controlling agent 0–5 wt%
  Plus charge toner: nigrosine class electron donor dye, alkoxyl amine, alkylamide, chelate, pigment, quaternary ammonium salt and the like
  Minus charge toner: electron acceptor organic complex, chrolinated paraffin, chrolinated polyester, polyester with excess acid radical, chrolinated copper phthalocyamine and the like (4) Fluidizing agent
  Ex: colloidal silica, silica anhydride, silicon varnish, metallic soap, nonionic surface active agent and the like (5) Cleaning agent (to prevent filming of toner on a photosensitive material)
  Ex: fatty acid metallic salt, silicon oxide acid having organic group on its surface, fluorine class surface active agent and the like (6) Fillers (to improve surface luster of a toner image and to lower material cost)
  Ex: calcium carbonate, clay, talc, pigment and the like, or, other than these materials small amount of magnetic powder may be added to prevent fogging on image surface and scattering of toner)

For such magnetic powder, 0.1–5 wt % triiron tetroxide, γ-ferric oxide, chromium dioxide, nickel ferrite, iron alloy powder or the like each of which having particle diameter 0.1–1 mm is used. Additionally, less than 1 wt % of such powder may be employed in order to maintain vivid colors.

Additionally, as a resin suitable for pressure-fixing type toner which plastic-deforms under approx. 20 kg/cm force to fix on a paper, self-adherent resins such as wax, polyolefines, ethylene-vinyl accetate copolymer, polyurethane, rubber and the like are utilized.

With the above-mentioned materials, toner may be prepared by using a production method conventionally known in the art.

To obtain more favorable images with an apparatus according to the invention, it is desirable a particle diameter (weight-average) of toner is less than approx. 15 μm, and, more specifically, 9–1 μm. If the particle diameter exceeds 9 μm, it is difficult to attain satisfactory resolution and gradient reproducibility. If the diameter exceeds, especially, 15 μm, fine characters tends to be not discernible, and, contrary, if the diameter is less than 1 μm, fogging occurs and sharpness of images is lowered. Incidentally, in the invention, a particle diameter or average particle diameter of toner as well as of carrier refers to a weight-average particle diameter, and, the weight average particle diameter is the value measured with a Colter counter (manufactured by Colter Co., Ltd.). Additionally, a specific resistance of particle is measured in the following manner. Particles are poured into a container having 0.50 $cm^2$ sectional area. Then the container as containing the particles is tapped and 1 $kg/cm^2$ weight load is applied upon the packed particles to make the thickness approx. 1 mm. Then, $10^2$–$10^5$ V/cm electrical field is exerted across the load and an electrode located at the bottom, then the value of flowing current is measured to determine the resistance.

Additionally, the constitution of carrier is as follows. Principally, the materials previously described as those constituting toner are also employed.

Carrier particles involve magnetic particles and resin as principal components. To improve resolution as well as gradient reproducibility, it is desirable that every carrier particle is made spherical and that its weight-average particle diameter is preferably less than 100 μm, and, more specifically, more than 5 μm and less than 50 μm. By making every carrier particle spherical, the force exerted on carrier while it passes through the gap between a resilient plate member and a developer transporting member evenly works on carrier as a whole. Accordingly, crushing, wearing and the like of carrier is reduced, thus providing carrier with longer service life. The particle diameter of carrier exceeding 50 μm, and, more specifically, 100 μm, hinders lamination of developer layer, deteriorating developability and jeopardizing image quality. Additionally, the particle diameter less than 5 μm deteriorates the developability, triboelectrification properties and fluidity of developer, and generates scattering of carrier.

To prevent carrier from being applied electrical charge and causing to adhere on the surface of photosensitive material, or, electrical charge to form a latent image from deenergizing, due to bias voltage, it is desirable that carrier is of insulating nature and has an electrical resistance more than 10 Ωcm, and, more favorably, more than $10^{13}$ Ωcm, and, furthermore favorably, more than $10^{14}$ Ωcm.

Such carrier is obtained by coating the surface of magnetic material with resin, or by distributing magnetic fine particles into resin, then classifying the resulted particles with a known particle size classification means.

Furthermore, when making carrier particles spherical, the following processes are carried out.

(1) Resin-coated carrier: to select spherical-shaped particles as magnetic particles.

(2) Magnetic particle-distributed carrier: to produce spherical-shaped particle-distributed resin particles after forming the particle-distributed resin grains by providing them with sphering treatment with hot air or hot water, or by directly forming spherical-shaped resin particles in which magnetic particles have been distributed.

When carrier particles are made spherical, the force carrier receives while passing through the gap between a developer transporting member and a resilient plate member is equally born by whole carrier to pass through the gap, reducing the damage on carrier and providing longer service life for carrier.

The above-mentioned toner and carrier are preferably mixed in a proportion where each total surface area of the toner and carrier is approximately equal with each other. For example, when toner has an average particle diameter 10 μm and density 1.2 $g/cm^3$, and carrier has an average particle diameter 20 μm and density 4.5 $g/cm^3$, the concentration of toner (weight ratio of toner within developer) may be set at 5–40 wt %, or, preferably, 8–25 wt %.

In the case of developer according to the invention, the particle diameter of carrier is, in contrast to a conventional developer wherein larger carrier particles are coated with greater number of smaller toner particles, smaller than that of conventional one and nearly equals to that of toner. For this reason, the mixing ratio where each total surface area of the toner and carrier being approximately equal with each other is preferable.

Additionally, developer applicable in the present invention is not limited only to the previously mentioned two-component developers. Three-component developers which have, for example, a second nonmagnetic toner of different color in addition to magnetic carrier and nonmagnetic toner, or three-component developers which involve magnetic toner may be also applicable. Developers containing various additives in addition to such carrier and toner can also provide a stable and uniform thin layer.

(EXAMPLES)

The present invention is more specifically described below by referring to examples. These are embodiments where the method for forming developer layer is applied in multi-color image forming apparatus.

FIG. 18*a* illustrates the constitution of an image forming apparatus to be employed. An image input unit IN is unit-built and comprises an illuminating light source 1, a mirror 22, a lens 23 and a one-dimensional color CCD image sensor 24. The image input unit IN can be shifted in the direction shown by an arrow x with an unshown driving mechanism, and the CCD image sensor 24 reads an original draft. Instead, with the image input unit IN being stationary, a draft table may be shifted to shift the original draft 25.

The image information read by the image input unit IN is converted into data suitable for recording at an image processing unit TR.

A laser optical system 26 forms a latent image on the image forming member 20 in the following manner and based on the above-mentioned image data. Such a latent image is developed and a toner image is formed on the image forming member 20. The surface of image forming member 20 is evenly electrified with a Scorotron electrification electrode 27. Then, image exposure light L with the recorded data incorporated is illuminated from the laser optical system 26 via a lens upon the image forming member 20. In this way, an electrostatic latent image is formed. Such an electrostatic latent image is developed by a developing unit A containing yellow toner. The image forming member 20 on which a toner image has been formed is again evenly electrified by the Scorotron electrification electrode 27 and receives image exposure light L into which recorded data of another color element has been incorporated. The formed electrostatic latent image is developed by a developing unit B containing magenta toner. As a result, a two-color toner image of yellow toner and magenta toner is formed on the image forming member 20. Similarly, cyan toner as well as black toner are consecutively developed to form a four-color toner image on the image forming member 20. Additionally, the developing units AX, BX, CX and DX respectively containing each color toner, mentioned above, commonly have the constitution similar to that of the developing unit in FIG. 16.

In developing units AX, BX, CX and DX, now referring FIG. 16, a non-magnetic sleeve 3 internally contains a magnetic roll 4 which rotates in the direction same as the an image forming member 1. The magnetic roll 4 transporting developer comprises four S poles and four N poles which are alternately disposed. The strength of magnetic field at 1 mm above the sleeve is preferably 500–1500 Gauss. In this example, 700 Gauss-strong magnetic roll was used. For non-magnetic sleeve 3, stainless steel having 1–10 μm concaves and convexes on its surface is preferable. In this example, 20 mm dia. cylindrical sleeve on which 3 μm concaves and convexes are provided is used as a non-magnetic sleeve 3. The revolution of non-magnetic sleeve is preferably 100–500 rpm, and 240 rpm is selected for this example. The revolution of magnetic roll 4 is preferably 2–5 times as large as that of non-magnetic sleeve 3, and 800 rpm is selected for this example. A resilient plate member 5 is secured on a resilient plate member securing member 6. The thickness of resilient plate member 5 is preferably 0.05–0.2 mm, and 0.1 mm was selected for this example. The elastic modulus of the resilient plate member 5 is preferably 5000–25000 kgf/mm$^2$, and 11000 kgf/mm$^2$ was used for this example. Additionally, as a material for the resilient plate member 5, stainless steel, copper, brass, steel and the like are preferable, and phosphor bronze was used for this example. The length (free length) from the position where the resilient plate member 5 is secured on the resilient plate member securing member 6 to the end tip of the resilient plate member 5 is preferably within the range of 5–20 mm, and 15 mm was selected for this example. The plate member contacts the non-magnetic sleeve 3 at 1 mm from its tip as the tip margin, and, additionally, its linear pressure as the pressing force for the resilient plate member 5 is preferably within the range of 0.5–10 g/mm. In this example, the plate member is disposed so that its linear pressure is 1 g/mm. The linear pressure can be determined by the following formula which was already mentioned.

$$F = \frac{Et^3}{6} \cdot \frac{\theta}{PQ^2} = \frac{Et^3}{6} \cdot \frac{1}{\left(\frac{m^2 + S^2 - 2Sr}{2S}\right)^2 \operatorname{Sin}^{-1}\left(\frac{2Sm}{m^2 + S^2}\right)}$$

Bias voltage (AC 2 kHz, 1.2 kVp-p, 500 VDC) is applied by a power supply 14 upon the non-magnetic sleeve 3. Agitating plates 7 and 8 are disposed within a developer container. With the exception of the power supply 14, these members are contained in a casing 2. Toner contained in a toner container 11 is transferred into developer containers with a control member 12 for supplying toner, where being mixed into developer 13 with the agitating plates 7 and 8. Developer 13 is retained on the non-magnetic sleeve 13 with the magnetic force of the magnetic roll 4, where it is formed into a developer layer having a specific thickness (250–450 μm for this example), being transferred to a developing area, where a latent image on the image forming member 1 is developed.

Figure 18:
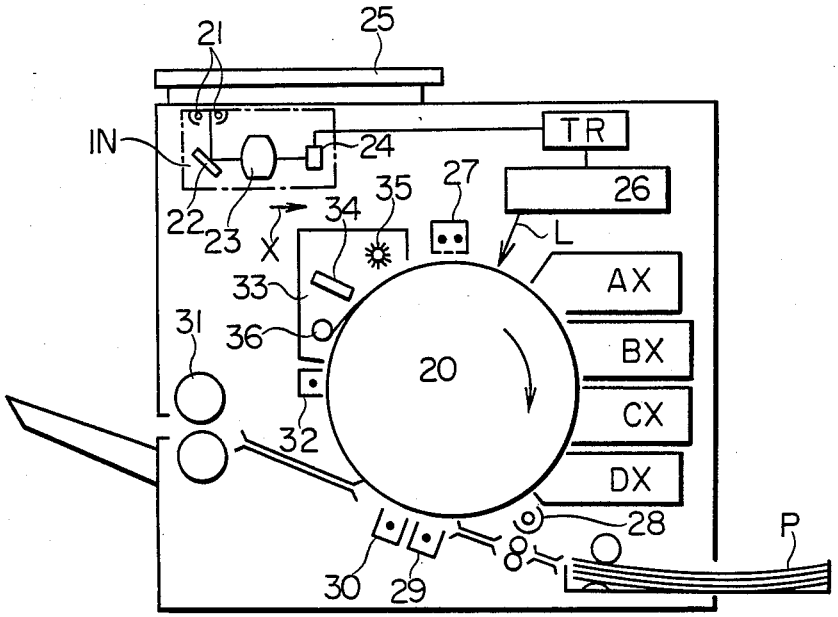
Figure 18B:
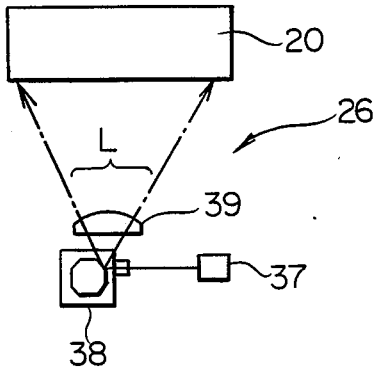

Now referring FIG. 18-*a*, a multi-color toner image obtained in such a manner is transferred on a recording paper P with a transfer electrode 29 after being neutralized for easy transfer by an exposure lamp 28. The recording paper P is separated by a separation electrode 30 from the image forming member 20 and is fixed with a fixer 31. At the same time, the image forming member 20 is cleaned by a neutralization electrode 32 as well as a cleaning mechanism 33.

The cleaning mechanism has a cleaning blade 34 and a fur brush 35 which are kept out of contact with the image forming member 20 during formation of an image. Once a multi-color image is formed on the image forming member 20, they come in contact with the image forming member 20 and scrape off toner left untransferred on the member. Then, the cleaning blade 34 leaves the image forming member 20, and, a little later, the fur brush also leaves the image forming member 20. The fur brush 35 functions to remove toner left on the image forming member 20 after the cleaning blade 34 leaves the image forming member 20. Numeral 36 denotes a roller which collects toner scraped off by the blade 34.

Additionally, instead of the fur brush 35, a flexible roller such as a sponge roller may be used.

A laser optical system 26 is shown in FIG. 18-*b*. In this figure, numeral 37 denotes a semiconductor laser generator, numeral 38 a rotatable polygon mirror, and numeral 39 a fθ lens.

In such an image forming apparatus, it is advantageous to carry out with a timing for starting image-wise exposure by providing an optical reference mark for positioning of each image on an image forming member and by reading the mark by a light sensor or the like.

With a photocopying machine in FIG. 18*a*, the above-mentioned image forming process is carried out through reversal development using a developer having the following prescription, and image forming is practiced under the image forming conditions specified in Tables 1 and 4.

(DEVELOPER PRESCRIPTION)

| | | |
|---|---|---|
| Toner composition | polystyrene | 45 parts by weight |
| | polymethyl methacrylate | 44 parts by weight |
| | Varifast (charge-controlling agent) | 0.2 parts by weight |
| | Colorant | 10.5 parts by weight |

In this prescription, colorant comprises Auramine as yellow toner, rhodamine B as magenta toner, copper phthalocyanine as cyan toner and carbon black as black toner. The components, above, are mixed, knead and classified to produce toner particles as required.

| Carrier (resin-coated carrier) composition: | |
|---|---|
| Core: ferrite | |
| Coating resin: styrene/acrylic (4:6) | |
| Magnetization | 27 emu/g |
| Particle diameter | 30 μm |
| Specific gravity | 5.2 g/cm$^3$ |

The above-mentioned components are mixed, knead, classified, and dried with hot air to produce spherical carrier particles.

Then, 88 parts weight of above-mentioned carrier is thoroughly mixed with 12 parts weight of each color toner to prepare each of developers as required.

TABLE 1-continued

| Image forming member and developing unit | | Condition |
|---|---|---|
| | | 800 rpm |
| | Magnetic flux density (maximum) on the sleeve surface | 700 G |

TABLE 4

| Other processing methods | |
|---|---|
| Transferring | Corona dischaging method |
| Fixing | Heat roll method |
| Cleaning | With blade and fur brush |

TABLE 2

| Developer | | Condition | | | | |
|---|---|---|---|---|---|---|
| | | Average particle diameter (μm) | Specific gravity (g/cm$^3$) | Specific resistance (Ωm) | Amount of electrification (μc/g) | Toner density (wt %) |
| Carrier | | 30 | 4.6 | More than $10^{14}$ | Resin coated ferrite particle with magnetization 18.4 e.m.u./g | |
| Toner | Yellow | 8 | 1.2 | More than $10^{14}$ | −20 | 12 |
| | Magenta | 8 | 1.2 | More than $10^{14}$ | −20 | 12 |
| | Cyan | 8 | 1.2 | More than $10^{14}$ | −20 | 12 |
| | Black | 5 | 1.2 | More than $10^{14}$ | −25 | 10 |

TABLE 3

| Development | | Condition | | |
|---|---|---|---|---|
| | | D.C. | A.C. | |
| Bias at the time of development | Yellow development | −500 V | 2 kHz (Frequency) | 1.2 kV (Between peaks) |
| | Magenta development | −500 V | 2 kHz | 1.2 kV |
| | Cyan development | −500 V | 2 kHz | 1.2 kV |
| | Black development | −500 V | 2 kHz | 1.2 kV |
| Bias during non-development* | Applies to development of all different colors (With magnetic roll and sleeve inactive) | 0 V | More than 0.3 kV at 2 kHz | |
| Developing gap | | (Common to all developing units) 0.3 mm | | |
| Developer layer thickness in the developing area | | (Common to all developing units) 50 μm | | |
| Order of development | | (Yellow) → (Magenta) → (Cyan) → (Black) | | |

*During nondevelopment, the sleeve may be allowed to float electrically.

The first example is the image forming process mentioned previously and using the above-mentioned developer. The developing conditions for each functioning unit are shown in the following Tables 1 and 4.

TABLE 1

| Image forming member and developing unit | | Condition |
|---|---|---|
| Image forming member | Photosensitive layer | Organic photosensitive layer |
| | Drum diameter | 140 mm |
| | Circumferential speed | 60 mm/sec. |
| Electrification | Nonexposure area potential | −700 V |
| | Exposure area potential | −50 V |
| Image exposure L | Light source | Semiconductor laser |
| | Wavelength | 780 nm |
| | Recording density | 16 dots/mm |
| Developing units | Sleeve | Diameter, 20 mm dia. |
| Each of developint units AX, BX, CX and DX | Linear speed | 250 mm/sec. |
| | Magnetic roll | 8 poles |

Additionally, organic photosensitive layer in Table 1 comprises a function-separated photosensitive layer having a lower layer as a carrier generating layer containing trisazo dye and an upper layer as a carrier transporting layer containing aromatic amino compound. The developing method is non-contact developing method, and, at the same time, reversal developing method.

When a multi-color image was formed under the above-mentioned conditions, a similar image featuring excellent resolution as well as satisfactory reproduction of pseudo-intermediate tones composed of dots were realized. Additionally, splashing of toner and carrier was minimized.

(EXAMPLE 2)

Next, carrier prepared in the following manner was employed. Where, "part" refers to part by weight.

| | |
|---|---|
| Styrene-acrylic resin (monomer composition between styrene, buylacrylate and methylmethacrylate is 57:15:10) | 50 parts |
| Iron alloy (98 wt % Fe, 2 wt % Si; strength of saturation magnetization, 190 emu/g) | 50 parts |
| Charge controlling agent "Nigrosine SO" (manufactured by Orient Chemical Co., | 2 parts |

The components, above, were blended in a ball mill, knead with a pair of rollers, then pulverized and classified to prepare magnetic carrier having average particle diameter 30 μm.

While coated carrier has a specific gravity 4–5 g/cm$^3$, the abovementioned carrier in which magnetic material is distributed with resin has a specific gravity approximately 2 g/cm$^3$, which is much similar to the specific gravity, approximately 1 g/cm$^3$, or toner. For this reason, agitation of carrier and toner is more efficiency effected, and more homogeneous developer layer featuring smaller scattering is formed. The conditions including a layer thickness regulating plate and the like are identical with those for Example 1.

Similarly, this example also realized the results as satisfactory as Example 1.

(EXAMPLE 3)

FIG. 19 is a sectional view illustrating the principal area of an image forming apparatus which is arranged so as to form a multicolored image while an image forming member rotates one round. The parts or components denoted by numerals same as in FIG. 18-*a* have the functions indentical with their counterparts in FIG. 18-*a* have. The image forming apparatus in FIG. 19 differs from the apparatus in FIG. 18-*a* in that:

(1) Each of electrification electrodes 27A, 27B, 27C and 27D, and each of image exposure systems 26A, 26B, 26C and 26D respectively comprising a semiconductor laser, for example, are disposed respectively in the upstream side of each of developing units AX, BX, CX and DX which are provided on the outer circumferential surface of an image forming member 20, and;

(2) A cleaning mechanism 33 solely comprises a blade 34 for scraping off toner and a roller for collecting toner 36, and, the blade 34 is always being pressed upon the image forming member 20, and;

(3) The carrying path of a recording paper P is designed to form a turning path, allowing more mechanisms disposed around the outer circumferential surface of image forming member 20, and;

(4) In each developing unit, a resilient plate member having 0.05 mm thickness and 6 mm free length is used under pressing force 2 g/mm. Apart from these modification, all the conditions are identical with those in Example 1.

When forming, for example, a four-color image with this image forming apparatus, and even if the linear velocity of the outer circumferential surface of image forming drum is set equal to that of the apparatus in FIG. 18-*a*, the image may be formed approximately four times swiftly than the latter apparatus.

Next, a multi-color image was formed, as the third example, by using the image forming apparatus shown in FIG. 19.

Accordingly, the satisfactory results comparable to Example 1 was obtained.

Next, in relation to the method forming developer layer according to the invention, the modified examples of the previously described examples are described below.

Figure 10:
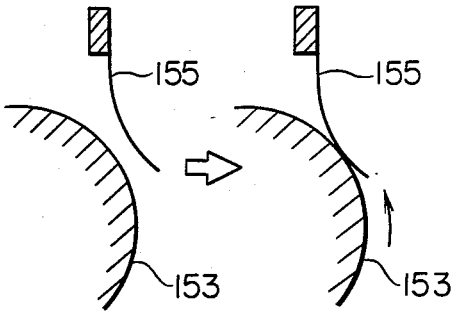

An example in FIG. 10 is one modification according to the invention. The requirements of the invention are that the amount of developer may be regulated by the linear pressure caused between a resilient plate member and a developer transporting member as well as by the height of opening gap between the resilient plate member and the developer transporting member, and that the stable and evenly thick developer layer may be formed by regulating the height of clearance where developer passes through identical to a diameter of single carrier particle. And the scope of the invention is not limited only the already mentioned cylindrical developer transporting members as well as resilient plate members which are commonly a flat plate when not receiving force. In this example, a plate member 155 is so bent that the surface of it to be pressed upon a developer transporting member 153 forms convexity. This arrangement enhances the lengthwise strength of the resilient plate member, allowing easy treatment of it during manufacturing and assembly. Additionally, if a developer transporting member is of a flat-type or having near-plane concavity, a resilient plate member 163 is required to be similarly bent, or a wedge-shaped gap does not form at the end tip of a resilient plate member, preventing developer from passing through the clearance between the resilient plate member and the developer transporting member.

Figure 13:
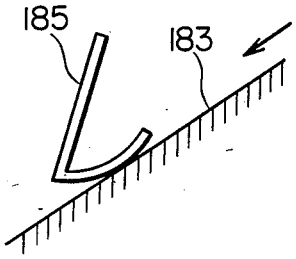

FIG. 12 shows still another modification according to the present invention. By forming a resilient plate member 175 into such a configuration, the forming position of developer, that is, where developer layer passing through may be placed in the close proximity of a latent image forming member thus reducing the distance from where the developer layer is formed to the developing area. Accordingly, the developer layer seldom catch flying toner or foreign matters, and, as well, scattering of toner or carrier from the developer layer into air may be minimized. Naturally, by giving an appropriate curvature at the tip of a resilient plate member 185 as shown in FIG. 13, such a resilient plate member may be applied not only to a cylindrical developer transporting member 173 but to a developer transporting member 183 of a flat-type of having nearplane concavity.

Figure 14:
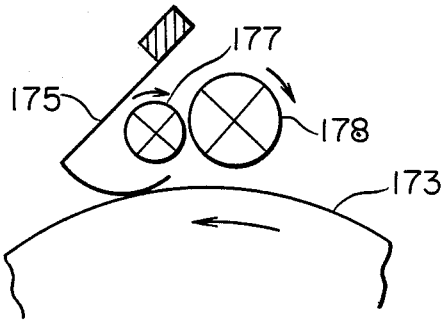
Figure 15:
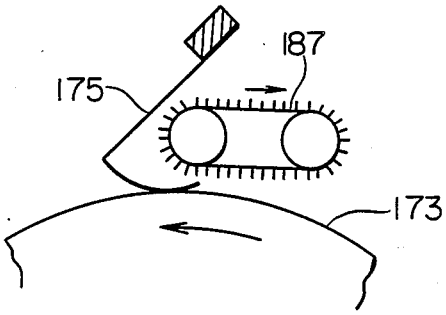

In this case, it is desirable to dispose an agitating member 177 or 187 shown in FIG. 14 or 15 in the close proximity of a resilient plate member 175 in order to ensure the circulation of developer scraped from a developer transporting member.

With the previously mentioned examples, developer layer thickness regulating means using a resilient plate member were described. The description of other examples of developer layer thickness regulating means is as follows.

A developer layer thickness regulating means in FIG. 23-*a* comprises a sleeve 303 internally provided with magnets, as well as a developer layer thickness regulating plate member 305 which is supported in such a manner that it can be lifted up, from the position where it is pressed upon the sleeve, by the force of developer D being fed into the gap formed between its tip and the sleeve. The regulating plate member 305 is pressed upon and in contact with the surface of sleeve 303 by means of a spring 307 or the like when there is no developer in the gap. However, when developer is being transported, as shown in FIG. 23-*b*, the plate member is lifted up by the developer rushing into the wedge-shaped gap formed between the sleeve 303 and the tip of plate member 305, causing the developer to pass through between the sleeve and the plate member 305. The thickness of developer to pass through between the sleeve 303 and the developer layer thickness regulating member 305 can be arbitrarily designated, by arbitrarily designating the factors including the force of magnets and magnetism of carrier to determine the force with which the developer is transported, as well as the factors including the weight of plate member 305 and the strength of spring 307 to determine the force with which the plate member 305 is pressed upon the sleeve 303. In relation to such an arrangement, there is the correlation, shown in FIG. 4, between the pressing force and the developer thickness, that is, the gap distance between the sleeve and the developer thickness regulating plate member. Accordingly, a stable and extremely thin developer layer can be formed by setting the gap between the sleeve and the plate member equal to the diameter of single carrier particle.

FIG. 24-*a* shows one example wherein a roller 308 capable of being rotated by unshown rotating mechanism is utilized instead of developer layer thickness regulating member. Like the above-mentioned plate member 305, the roller 308 being rotated at different speed from that of the sleeve 303 is contacted with the sleeve 303 by the spring 307 while there is no developer D on the sleeve 303. By maintaining the correlation similar to that in FIG. 4, a thin developer layer whose thickness equal to the diameter of single carrier particle can be formed between the roller 308 and the sleeve 303. FIG. 24-*b* is an enlarged fragmentary view of the principal area of one example which uses instead of the roller 308 a roller 307 supported by a spring or the like and being driven in the same direction as the sleeve 303 by means of an unshown rotation transmitting means. In this case, it is advantageous to set the circumferential velocity of roller 307 smaller than that of the sleeve 303. When the developer is transported into between the sleeve 303 and the roller 307, and if the developer layer is as thin as the diameter of single carrier particle, every carrier C particle is securely transported while rolling and being sandwiched between the sleeve 303 and the roller 309. However, with a developer layer whose thickness is larger than twice the diameter of carrier C particle, the carrying force working between carrier C particles is smaller and the rolling direction of one of two vertically piling carrier C particles differs from that of the adjacent particle. Consequently, excessive developer is rejected from the wedge-shaped gap formed between the sleeve 303 and the roller 309, again forcing the developer layer with the thickness equal to the diameter of single carrier C particle through between the sleeve 303 and the roller 309, thus allowing the stable and uniformly thick thin layer to form.

As can be understood from the descriptions, above, the present invention relates to a method for forming developer layer whereby a developer layer as required is obtainable by pressing a resilient plate member upon the outer circumferential surface of developer transporting member, allowing developer to pass through between the resilient plate member and the surface of developer transporting member. The above method advantageously utilize the phenomenon that, while developer passes as mentioned above, the resilient plate member in contact with the surface of developer transporting member can be lifted as much as the particle diameter of magnetic carrier contained in developer.

According to a developing method of the present invention, development of electrostatic latent image featuring high resolution, gradient reproducibility and image density is realized, by effectively eliminating foreign matters and the like within developer, and, without involving scattering of carrier as well as toner, and leaky discharging from a developer transporting member, providing easy assembly and adjustment, and, featuring high reliability. Furthermore, when a developing method of the present invention is incorporated into a color photocopying machine, color printer or the like, a compact apparatus featuring excellent tone reproducibility, free from contamination of color toner with another toner.

Incidentally, above examples use the two component-developer consisting of the magnetic carrier and toner as one preferred example of the invention, however, it is also possible to use one component-developer and keep the gap substantially equal to the diameter of single developer particle by suitably adjusting the pressing force and so on in accordance with the developer.

What is claimed is:

1. A method of regulating the thickness of a developer layer containing magnetic carrier particles and toner particles, said developer layer formed on a developer transporting means comprising a magnet member therein, said method comprising;

transporting the developer layer by the developer transporting means to an elastic layer-thickness regulating means disposed so as to face and come in pressing contact with the transporting means, lifting the elastic layer-thickness regulating means by the transported developer, so that a gap made substantially equal to an average diameter of one of said carrier particles is formed between the lifted elastic layer-thickness regulating elastic means and said developer transporting means, and regulating the thickness of the developer layer by transporting the developer so as to pass through said gap.

2. The method of claim 1 wherein said carrier particles are spherical.

3. The method of claim 2 wherein the average diameter of said carrier particles is 5 to 50 μm.

4. The method of claim 1 wherein said developer transporting means is disposed to face a rotational image surface of an image carrying member with a distance therebetween to form a developing zone so that an electrostatic latent image on said rotational image surface is developed in the developing zone with a developer transported by said developer transporting means, and wherein the thickness of said developer layer is regulated by said elastic means so as to be less than said distance.

5. The method of claim 4 wherein an electric bias having an oscillating component is applied between said image carrying member and said developer transporting means.

6. The method of claim 5 wherein said developer transporting means comprises a cylindrical sleeve member and a magnetic member provided inside said sleeve member.

7. The method of claim 6 wherein said magnetic member is rotatable.

8. The method of claim 7 wherein said carrier particle is spherical.

9. The method of claim 8 wherein the average diameter of said carrier particles is 5 to 5 μm.

10. The method of claim 7 wherein said carrier particles are electrically insulated.

11. The method of claim 1 wherein said developer-regulating elastic means is an elastic plate member.

12. The method of claim 11 wherein a free end of said elastic plate member is placed against said developer transporting means in a direction of movement of the developer.

13. The method of claim 12 wherein said carrier particles are spherical.

14. The method of claim 13 wherein the average diameter of said carrier particles is 5 to 50 μm.

15. The method of claim 14,
wherein the diameter (d) of single carrier particle and the thickness regulating distance (ε) satisfy the following relation;

$$0.9 \times d \leqq \epsilon \leqq 2.0 \times d.$$

16. The method of claim 15,
wherein the layer thickness-regulating means comprises an introducing member for introducing the developer layer into the pressing portion, and
wherein said method further comprises a step of controlling the introduced quantity of the developer into the pressing portion.

17. The method of claim 16,
wherein the introducing gap forms a wedge-shaped gap, and
wherein said controlling step comprises a step of regulating the introduced quantity of the developer into the pressing portion through the wedge-shaped gap.

18. The method of claim 17,
wherein the layer thickness-regulating means is a resilient plate member of which one end is fixed to be stationary and other end is free and comes in contact with the developer layer, and
wherein the resilient plate member forms an arc shape between the both ends thereof, thereby causing a pressing force on the developer layer.

19. The method of claim 18,
wherein the free end of the resilient plate member further extends from the pressing portion in order to perform as the introducing member.

20. The method of claim 19,
wherein said free end of the resilient plate member separates the transported developer into two groups of which one group is introduced into the wedge-shaped gap along one face of the resilient plate member and other group is transported along other face of the resilient plate member.

21. The method of claim 20,
wherein the elastic modulus of the resilient plate member is 5000 to 5000 Kg/mm$^2$.

22. The method of claim 21,
wherein the elastic modulus of the resilient plate member is 7000 to 22000 Kg/mm$^2$.

23. The method of claim 22,
wherein the thickness of the resilient plate member is 0.03 to 0.2 mm.

24. The method of claim 23,
wherein the thickness of the resilient plate member is 0.05 to 0.15 mm.

25. The method of claim 24,
wherein the pressing force is 1 to 10 g/mm.

26. The method of claim 25,
wherein the pressing force is 1 to 5 g/mm.

27. The method of claim 26,
wherein the length, from the pressing portion to the free end, of the resilient plate member is 1 to 3 mm.

28. The method of claim 27,
wherein the entrance height of the wedge-shaped gap is 0.08 to 0.3 mm.

29. The method of claim 28,
wherein the developer transporting means is a cylindrical shape and the resilient plate member is made of a resilient flat plate.

30. The method of claim 29,
wherein the developer transporting means, of which the axis is arranged to become horizontal, has a transporting direction along the circumference of the cylindrical shape, and
wherein the pressing portion is located at a point on the circumference which has the circumferential angle more than 30 deg. from the lower most point of the circumference to the transporting direction.

31. The method of claim 30,
wherein the circumferential angle is more than 60 deg.

32. The method of claim 31,
wherein the pressing portion is covered over by the developer, and
wherein the depth of the pressing portion from the top surface of the developer is more than 2 mm.

33. The method of claim 32,
wherein the depth is more than 5 mm.

34. The method of claim 33,
wherein the length (PQ) of the arc of the resilient plate member corresponding to the length from the fixed end portion to the pressing portion satisfies the following relation with the diameter (r) of the developer transporting means, $$0.5 \times r \leqq PQ \leqq 2 \times r.$$

35. The method of claim 34,
wherein the length (PQ) satisfies the following relation, $$0.7 \times r \leqq PQ \leqq 1.5 \times r.$$

36. The method of claim 17,
wherein the layer thickness-regulating means comprises a plate member and a pressing means, and
wherein the plate member is so biased as to come in pressing contact with the developer layer by the pressing means.

37. The method of claim 36,
wherein the pressing means is a spring member.

38. The method of claim 37,
wherein the plate member has a end portion performing as the introducing member which forms the wedge shaped-gap in between with the developer transporting means, and
wherein the end portion has an edge portion separating the transported developer into two groups of which one group is introduced into the wedge-shaped gap and other group is transported along the side of the plate member.

39. The method of claim 17,
wherein the layer thickness-regulating means comprises a roller means and a pressing means, and
wherein the roller means is so biased as to come in pressing contact with the developer layer by the pressing means.

40. The method of claim 39, wherein the roller means comprises a roller member and a driving mechanism, and wherein the roller member is rotated in a different speed from the transporting speed of the developer transporting means by the driving mechanism so that the transported quantity of the developer into the wedge-shaped gap between the roller member and the developer transporting means can be controlled.

41. The method of claim 40, wherein the roller means comprises a roller member and a driving mechanism, and wherein the roller member is rotated to a different direction at the pressing portion from the transporting direction of the developer transporting means so that the transpoted quantity of developer into the wedge-shaped gap between the roller member and the developer transporting means can be controlled.

42. The method of claim 1, wherein the diameter (d) of single carrier particle and the thickness regulating distance ($\epsilon$) satisfy the following relation;

43. A method of regulating a thickness of a developer layer containing magnetic carrier particles and toner particles, said developer layer formed upon a developer transporting means comprising a magnetic member, said method comprising;

transporting the developer by the developer transporting means to a layer-thickness regulating means, said regulating means being positioned a distance from the developer transporting means so as to form a thickness regulating portion therebetween, separating the transported developer into at least two portions and introducing one of said portions into the thickness regulating portion, thereby metering the quantity of said developer introduced into the thickness regulating portion, pressing the introduced developer, thereby regulating the thickness of the developer layer transported through the thickness regulating portion by the developer transporting means, said thickness-regulating portion being adjusted to be substantially equal to the diameter of a single carrier particle.

* * * * *